US006834815B2

(12) United States Patent
Appleby

(10) Patent No.: US 6,834,815 B2
(45) Date of Patent: Dec. 28, 2004

(54) FLUID DISPENSING DEVICE

(76) Inventor: Kenneth L. Appleby, 21330 Parthenia St., Canoga Park, CA (US) 91304

( * ) Notice: Subject to any disclaimer, the term of this patent is extended or adjusted under 35 U.S.C. 154(b) by 63 days.

(21) Appl. No.: 10/438,902

(22) Filed: May 16, 2003

(65) Prior Publication Data

US 2004/0227012 A1 Nov. 18, 2004

(51) Int. Cl.[7] ..... A62C 11/00

(52) U.S. Cl. ..... 239/334; 239/587.4; 239/587.1; 222/377; 222/464.4; 222/464.7; 222/383.3; 222/383.1

(58) Field of Search ..... 239/334, 587.4, 239/587.1, 587.2, 587.3, 464.4, 464.6, 588, 525, 332; 222/383.1, 383.3, 377, 464.7

(56) References Cited

U.S. PATENT DOCUMENTS 2,805,795 A * 9/1957 Barnes ..... 222/184
5,062,549 A * 11/1991 Smith et al. ..... 222/377
5,464,129 A * 11/1995 Ho ..... 222/377
5,518,150 A * 5/1996 Witt, Jr. ..... 222/377
6,027,041 A 2/2000 Evans
6,059,152 A 5/2000 Mayfield
2001/0032864 A1 10/2001 Shepherd

FOREIGN PATENT DOCUMENTS

DE 3829962 C1 5/1989

* cited by examiner

*Primary Examiner*—Dinh Q. Nguyen
(74) *Attorney, Agent, or Firm*—Richard C. Litman

(57) ABSTRACT

A fluid dispensing device is provided in the form of a spray container. The spray container is formed with a protruding sump region formed along the bottom of the container. The thickness of the bottom of the container is tapered such that the lowest point in the upright container is in the distal end of the protruding sump region. The container further includes a rotating trigger spray head mounted on the container top and a rotating suction tube extending from the container top into the protruding sump region.

7 Claims, 5 Drawing Sheets

FLUID DISPENSING DEVICE

BACKGROUND OF THE INVENTION

1. Field of the Invention

The present invention relates to a fluid dispensing device in the form of a spray bottle having a rotating trigger spray head, and having a sump region formed at the bottom of the bottle.

2. Description of the Related Art

For products provided to consumers in spray dispensing containers, a typical problem is ensuring that the consumer can dispense the full measure of contents in the container. Numerous fluid dispensing devices are known which are designed with means to enable most of the fluid content of a container to be dispensed from the container. For example, U.S. Pat. No. 6,059,152, issued May 9, 2000 to Mayfield, describes a trigger spray container with integral straw guide. The container is formed with a ramp for guiding the distal end of a flexible straw attached to the trigger spray apparatus into contact with a base corner formed in the container bottom. The trigger spray apparatus is pivotally mounted on the container such that the contents of the container may be emptied when directing spray in an upward or downward direction.

German Patent No. 3,829,962, published May 5, 1989, teaches a container with a concave bottom for extending the flexible suction tube of a trigger-actuated spraying device into a corner region of the bottom surface. Spraying in a downward direction empties the last of the contents remaining in the container.

U.S. Pat. No. 6,027,041, issued Feb. 22, 2000 to Evans, shows a hose capable of bending 180° without kinking attached to the spray head of a fluid dispensing device. A weight is attached to the distal end of the hose to urge the end of the hose into the lowest point in the device so that the pump is supplied with liquid no matter what angle the spray is directed.

U.S. Patent Publication No. US 2001/0032864, published Oct. 25, 2001, teaches a fluid container for a pump or spray device wherein the bottom of the container is sloped downwardly at an angle toward a central depression in the bottom of the container. A straight suction tube extends from the pump or spray device into the central depression to allow substantially all of the contents of the container to be dispensed with the container in an upright position.

None of the above inventions and patents, taken either singly or in combination, is seen to describe the instant invention as claimed. Thus a fluid dispensing device solving the aforementioned problems is desired.

SUMMARY OF THE INVENTION

The present invention provides a fluid dispensing device in the form of a spray container. The spray container is formed with a protruding sump region formed along the bottom of the container. The thickness of the bottom of the container is tapered such that the lowest point in the upright container is in the distal end of the protruding sump region. The container further includes a rotating trigger spray head mounted on the container top and a rigid suction tube extending from the container top into the protruding sump region. When the nozzle of the spray head is aligned in the same radial direction as the protruding sump region of the container, the last of the fluid in the container can be dispensed with the container in an upright position or with the container tilted at an angle such that the spray is directed downwardly. When the nozzle of the spray head is rotated 180° from the radial direction of the protruding sump region of the container, the last of the fluid in the container can be dispensed with the container in an upright position or with the container tilted at an angle such that the spray is directed upwardly.

Accordingly, it is a principal object of the invention to provide a fluid dispensing device for dispensing the fluid in a spray, dispensing substantially all the fluid contents of the device when spraying in any direction.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
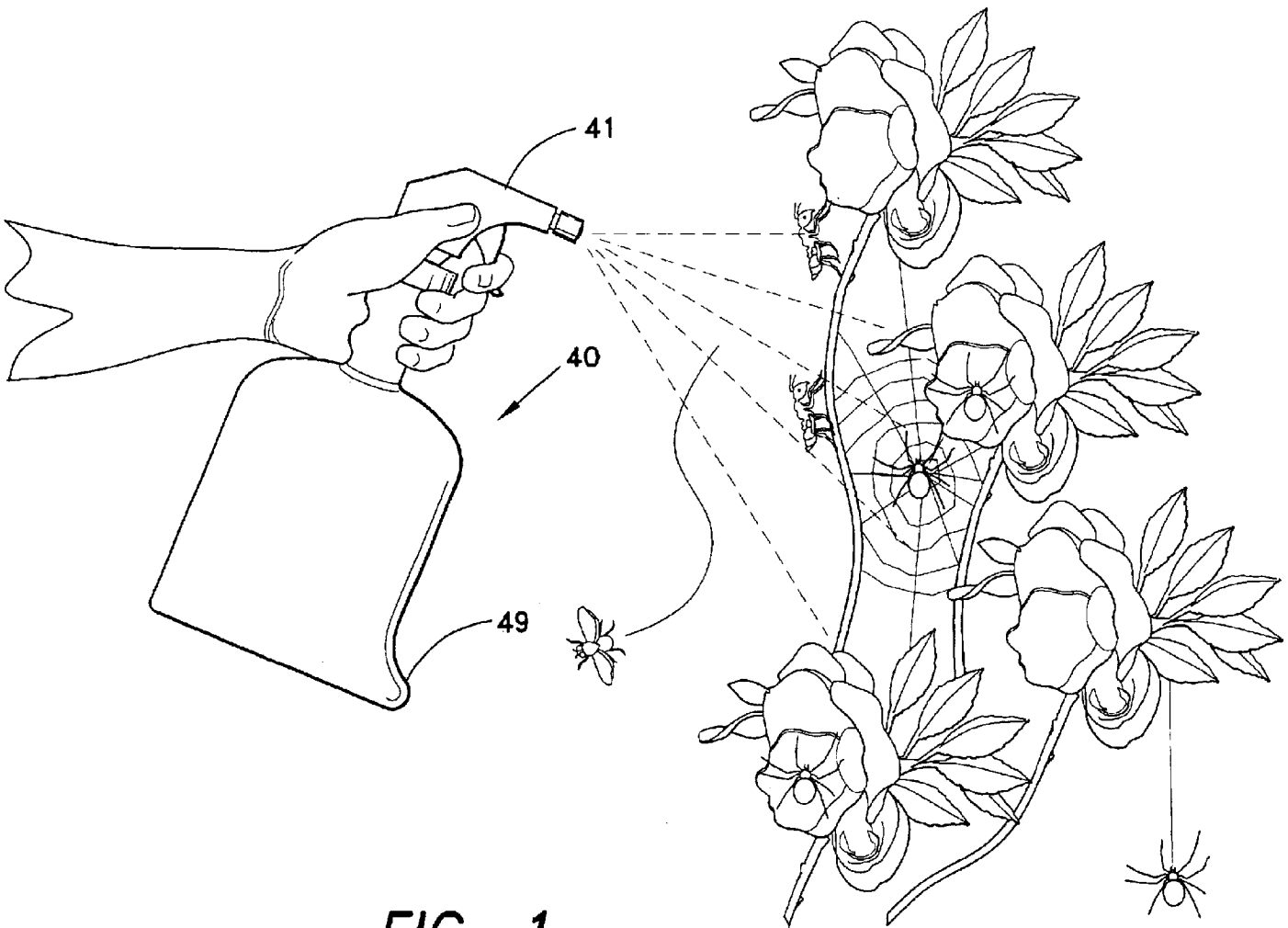
FIG. 1 is an environmental, perspective view of a fluid dispensing device according to the present invention.

The present invention provides a fluid dispensing device in the form of a spray container 40. Container 40 may be of any exterior bottle shape. The container 40 is made of conventional plastic materials for containing cleaning products, herbicides and pesticides for example. FIG. 1 shows container 40 with a conventional bottle shape with the exception of a protruding sump region 49 at the bottom of the container 40. The container is formed with a neck portion shaped for being grasped by a hand. FIG. 1 also shows a rotating trigger spray head 41 mounted on the container top so as to be actuated by the hand.

Figure 2:
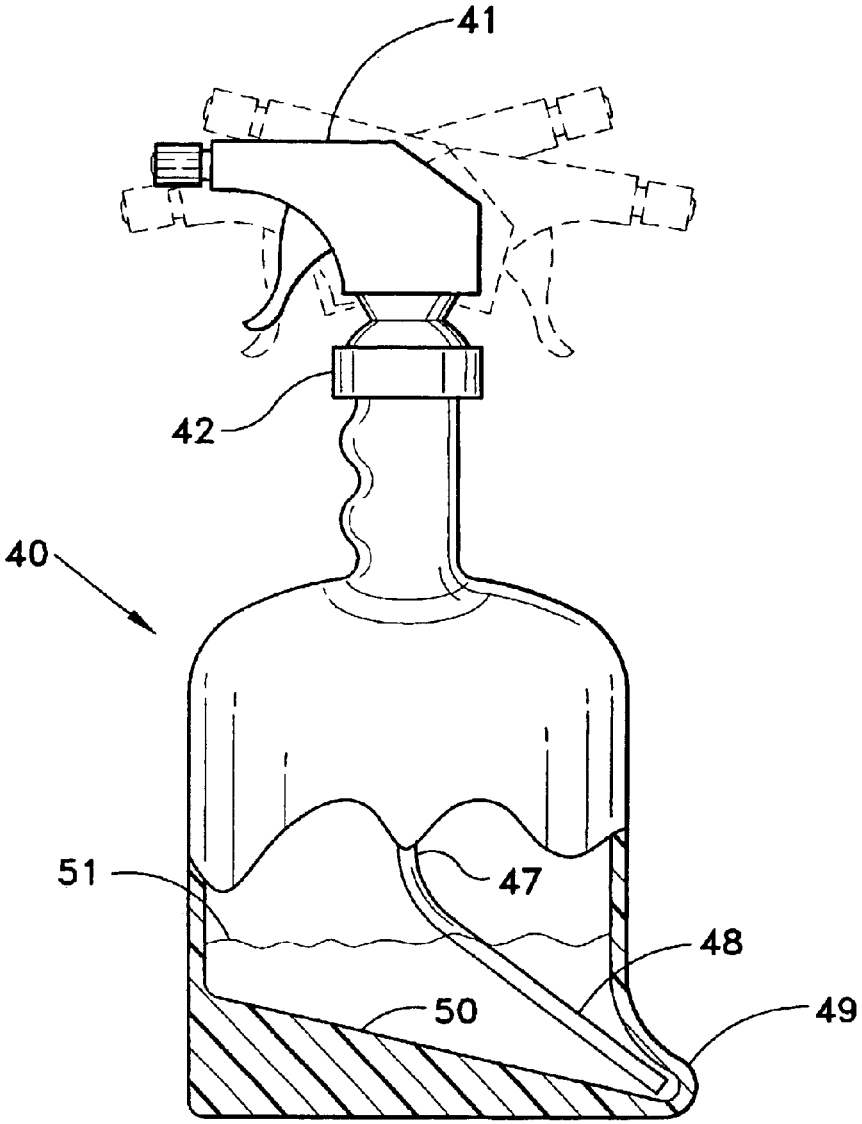
FIG. 2 is an elevation view of the fluid dispensing device according to the present invention with the container broken away and partly in section.
Figure 3:
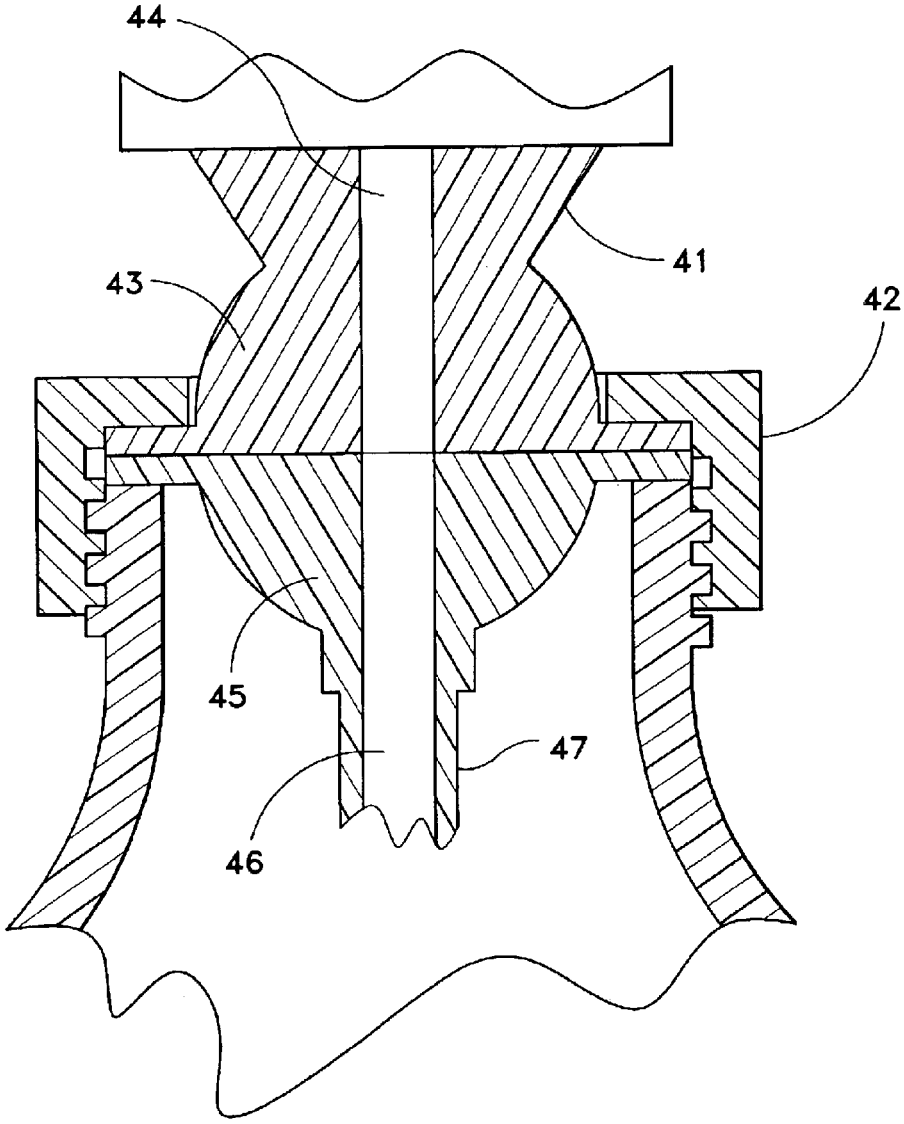
FIG. 3 is a fragmented, enlarged cross-sectional view of the suction tube and spray head connection of the fluid dispensing device according to the present invention.

Looking now at FIGS. 2 and 3, trigger spray head 41 is shown to have no suction tube directly connected to the flange 43 of spray head 41. The top of container 40 is in the form of a ring-shaped cap 42 attached to the spray head 41. FIG. 2 shows that the bottom of the container 40 is formed with a varying thickness such that the floor 50 slopes downwardly at a selected angle (preferably 15°) to the distal end of the protruding sump region 49 of the container 40. The interior of the protruding sump region 49 is the lowest portion of the upright container 40.

To supply spray head 41 with fluid 51 from the sump region 49, a suction tube 47 is provided. The tube is made of a substantially rigid plastic material and is formed with two portions. The two portions include a straight portion having a flange 45 for mating and sealing with the flange 43 of the spray head 41, and a sump portion 48 curved or otherwise bent and angled to extend from the straight portion into the protruding sump region 49 formed along the bottom of the container.

When the ring-shaped cap 42 of the spray head 41 is screwed onto the container 40, flange 43 and flange 45 are compressed by the cap, forming a seal connecting suction tube flange passage 46 with spray head flange passage 44. To reposition the spray head 41, the cap 42 is loosened, the head 41 rotated into a new position, and the cap 42 tightened to re-seal the flanges 44, 45.

Figure 4:
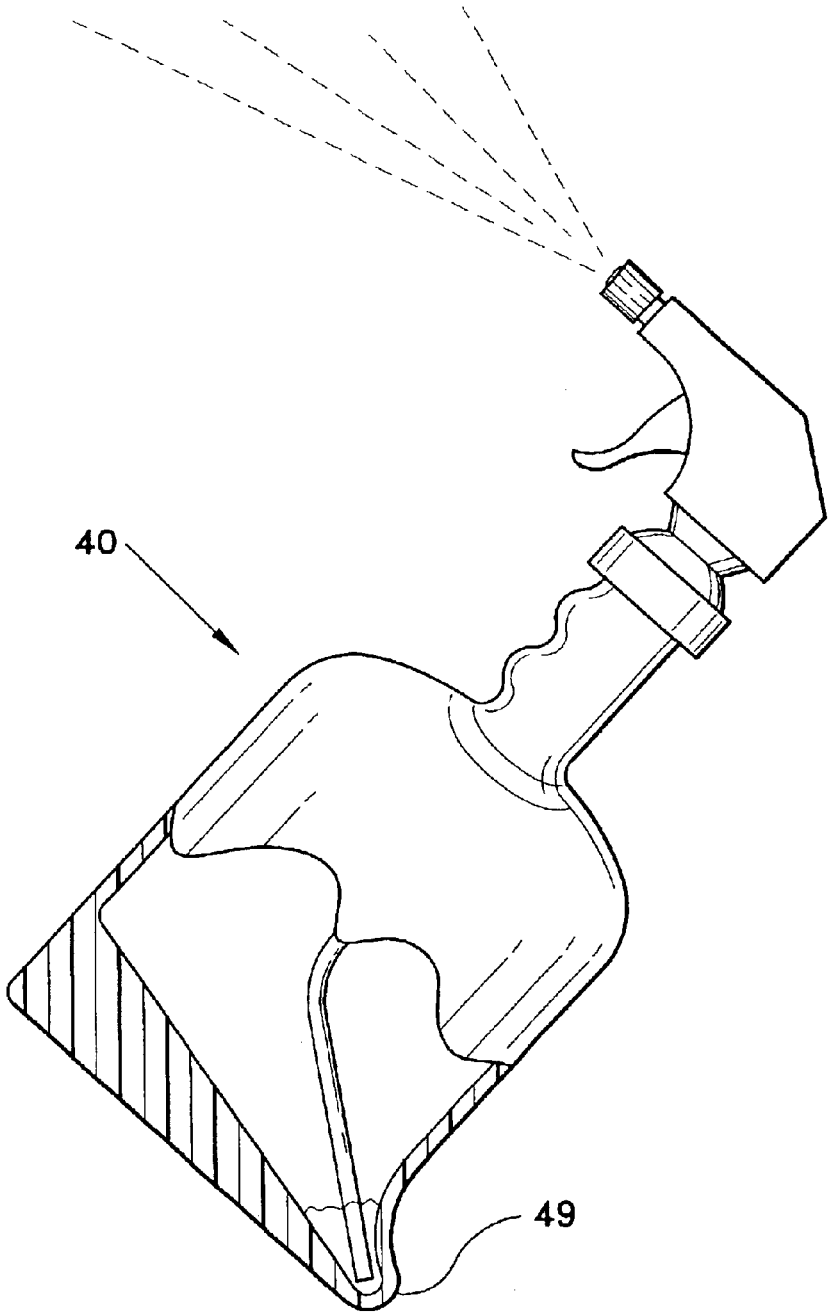
FIG. 4 is a side view of the fluid dispensing device according to the present invention tilted to direct an upward spray, the container being broken away and partly in section.
Figure 5:
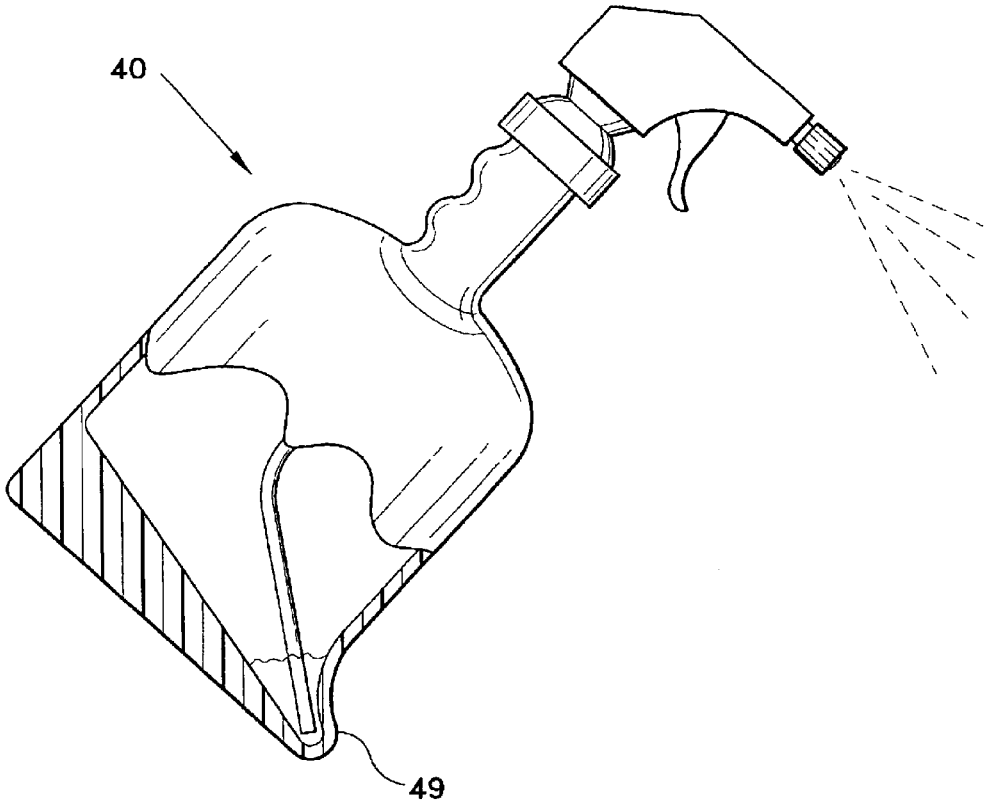
FIG. 5 is a side view of the fluid dispensing device according to the present invention tilted to direct a downward spray, the container being broken away and partly in section.

As shown in FIG. 5, with the nozzle of the spray head 41 aligned in the same radial direction as the protruding sump region 49 of the container 40, the last of the fluid 51 in the container can be dispensed with the container 40 held in an upright position or with the container 40 tilted at an angle such that the spray is directed downwardly. As further shown in FIG. 4, by rotating the nozzle of the spray head 41 to a position opposite the radial direction of the protruding sump region 49 of the container 40, the last of the fluid 51 in the container 40 can be dispensed with the container 40 held in an upright position or with the container 40 tilted at an angle such that the spray is directed upwardly. Thus the container 40 may be emptied of fluid contents while directing spray in any direction.

It is to be understood that the present invention is not limited to the embodiment described above, but encompasses any and all embodiments within the scope of the following claims.

I claim:

1. A fluid dispensing device, comprising:

a container having a protruding sump region at a bottom of the container; the container further having a mouth and a bottom of varying thickness such that the bottom slopes downwardly at an angle towards a distal end of the protruding sump region;

a rotating trigger spray head having a flange and an annular cap disposed about the flange, the cap being releasably attached to the mouth of the container; and a rigid suction tube extending from the cap into the protruding sump region, the tube having a tube flange abutting the spray head flange for sealingly connecting the spray head to the tube.

2. The fluid dispensing device according to claim 1, wherein said flanges are sealed between said cap and the mouth of said container.

3. The fluid dispensing device according to claim 1, wherein said tube has a straight portion extending downward from said cap a predetermined distance and an angled portion extending into said protruding sump region of said container.

4. The fluid dispensing device according to claim 1, wherein said tube is formed of a plastic material.

5. The fluid dispensing device according to claim 1, wherein said container, said cap, and said spray head are formed of a plastic material.

6. The fluid dispensing device according to claim 1, wherein each said flange includes a through passage, said passages being aligned when said flanges are sealed between said cap and the mouth of said container.

7. The fluid dispensing device according to claim 1, wherein the bottom of said container has a slope of about 15°.

* * * * *